US011384621B2

(12) United States Patent
Ring

(10) Patent No.: US 11,384,621 B2
(45) Date of Patent: Jul. 12, 2022

(54) AUTOMATIC FLOW CONTROL VALVE

(71) Applicant: TORSCH INC., Calgary (CA)

(72) Inventor: Curtis Ring, Calgary (CA)

( * ) Notice: Subject to any disclaimer, the term of this patent is extended or adjusted under 35 U.S.C. 154(b) by 370 days.

(21) Appl. No.: 15/984,240

(22) Filed: May 18, 2018

(65) Prior Publication Data

US 2019/0032449 A1 Jan. 31, 2019

Related U.S. Application Data

(60) Provisional application No. 62/536,730, filed on Jul. 25, 2017.

(51) Int. Cl.
*E21B 34/08* (2006.01)
*E21B 43/30* (2006.01)

(52) U.S. Cl.
CPC ..... *E21B 34/08* (2013.01); *E21B 43/305* (2013.01); *E21B 2200/06* (2020.05)

(58) Field of Classification Search
CPC .... E21B 37/08; E21B 2034/007; E21B 34/08; E21B 43/305; E21B 2200/06
USPC ..... 166/373
See application file for complete search history.

(56) References Cited

U.S. PATENT DOCUMENTS

2012/0111574 A1* 5/2012 Desranleau ..... E21B 34/14 166/373

* cited by examiner

*Primary Examiner* — Taras P Bemko
(74) *Attorney, Agent, or Firm* — Richard D. Okimaw

(57) ABSTRACT

An apparatus and method for controlling the flow of a fluid from a subterranean well zone to a pipe located within a bore in the well zone. The apparatus comprises an elongate tubular body having an interior passage and a valve passage extending between an exterior of the tubular body and the interior passage with a sliding sleeve adapted to selectably cover and uncover the valve passage. A chamber is formed on one end of the sliding sleeve with an elongate narrow passage extending thereto from the exterior of the tubular body, wherein a pressure drop of the fluid through the elongate narrow passage is adapted to move the sliding sleeve between a closed and an open position. A flow restrictor between the chamber and the interior passage of the tubular body has a pressure drop dependent only upon a flow rate of the fluid therethrough.

5 Claims, 6 Drawing Sheets

AUTOMATIC FLOW CONTROL VALVE

CROSS REFERENCE TO RELATED APPLICATION

This application claims priority to U.S. Provisional Patent Application No. 62/536,730 filed Jul. 25, 2017 entitled Automatic Flow Control Valve.

BACKGROUND OF THE INVENTION

1. Field of Invention

The present invention relates generally to hydrocarbon well control, and in particular to a method and apparatus for controlling inflow within a zone of a subterranean formation during production.

2. Description of Related Art

In hydrocarbon production, it has become common to utilize directional or horizontal drilling to reach petroleum containing rocks, or formations, that are at a horizontal distance from the drilling location. Horizontal drilling is also commonly utilized to extend the wellbore along a horizontal or inclined formation or to span across multiple formations with a single wellbore.

In horizontal hydrocarbon wells, it is frequently desirable to select which zone of the wellbore is to be opened for production. One method of selecting a zone to be opened is to provide valves within each zone which may be selectably opened to provide access to the zone, as desired by the user. One conventionally type of valve which may be utilized in such situations is a sleeve valve having a plurality of ports therethrough which may be selectably covered or uncovered by sliding a sleeve within a pipe.

During production, a zone may, at times, have excess water in the production zone, which is undesirable within the well. When there is excess water in a zone, valves must be closed to limit water contamination.

One current difficulty with the sleeve valves is that although zones may be selectably opened or closed, additional tools and sensors may be required to determine the location of the water inflow such that the correct valve(s) may be closed. Additionally, such valves may require a tool to be run into the valve to mechanically open or close it. It may be time consuming to detect which valve(s) must be closed and then to run the tool into the valve(s) to mechanically close them. Furthermore, should conditions within a zone change over time such that subsequently the water therein is redistributed or eliminated, valves must be periodically opened and tested to determine if the zone can be returned to production. This is also a time consuming operation.

SUMMARY OF THE INVENTION

According to a first embodiment of the present invention there is disclosed an apparatus for controlling the flow of a fluid from a subterranean well zone to a pipe located within a bore in the well zone comprising an elongate tubular body having an interior passage and a valve passage extending between an exterior of the tubular body and the interior passage with a sliding sleeve adapted to selectably cover and uncover the valve passage. The apparatus further includes a chamber formed on one end of the sliding sleeve and having an elongate narrow passage extending thereto from the exterior of the tubular body, wherein a pressure drop of the fluid through the elongate narrow passage is adapted to move the sliding sleeve between a closed and an open position and a flow restrictor between the chamber and the interior passage of the tubular body wherein the flow restrictor has a pressure drop dependent only upon a flow rate of the fluid therethrough.

The chamber may include a spring therein biasing the sliding sleeve to the closed position. The elongate narrow passage may be formed as a spiral chamber within a wall of the tubular body between the interior passage and the exterior of the tubular body. The elongate narrow passage may be formed between threading of a first and second tubular bodies. The threading may be adjustable in length so as to be operable to adjust the pressure drop therethrough.

According to a further embodiment of the present invention there is disclosed a method for controlling the flow of a fluid through a valve within a subterranean well zone comprising producing a first pressure drop between an exterior of a valve body and a chamber therein through an elongate passage and creating a second pressure drop between the chamber and an interior of the valve body dependent only upon a flow rate through a flow restrictor. The method further comprises displacing a sleeve within the valve body when the pressure within the chamber is below a desired pressure and uncovering an opening between the exterior and the interior of the valve body.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
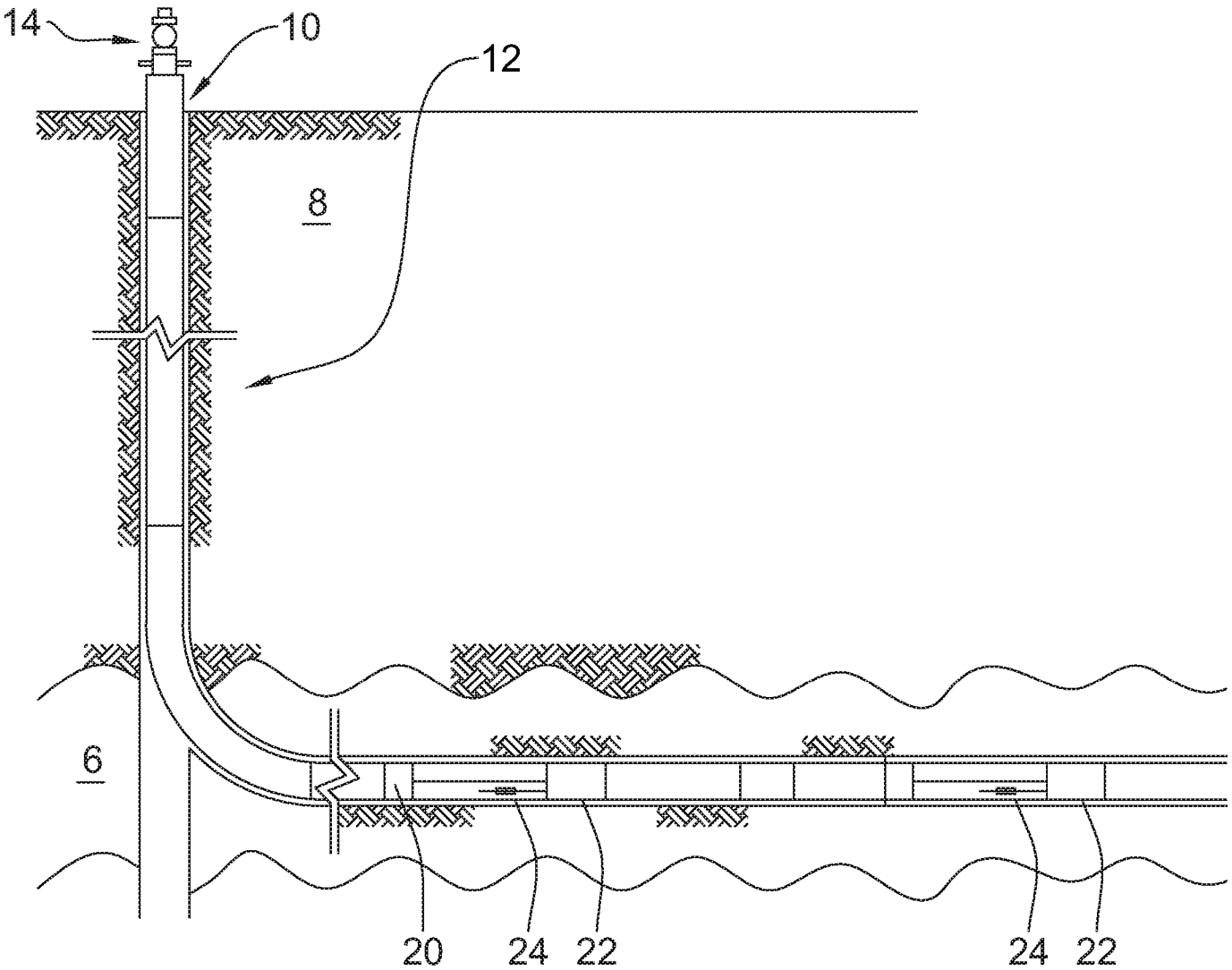
FIG. 1 is a cross-sectional view of a wellbore having a plurality of automatic flow control valves according to the first embodiment of the invention.

Referring to FIG. 1, a wellbore 10 is drilled into the ground 8 to a production zone 6 by known methods. The production zone 6 may contain a horizontally extending hydrocarbon bearing rock formation or may span a plurality of hydrocarbon bearing rock formations such that the wellbore 10 has a path designed to cross or intersect each formation. As illustrated in FIG. 1, the wellbore includes a vertical section 12 having a valve assembly or Christmas tree 14 at a top end thereof and a bottom or production section 16 which may be horizontal or angularly oriented relative to the horizontal located within the production zone 6. After the wellbore 10 is drilled the production tubing 20 is of the hydrocarbon well is formed of a plurality of alternating liner or casing section 22 sections and in line valve bodies 24. The valve bodies 24 are adapted to control fluid flow from the surrounding formation proximate to that valve body and may be located at predetermined locations to correspond to a desired production zone within the wellbore. In operation, between 2 and 100 valve bodies may be utilized within a wellbore although it will be appreciated that other quantities may be useful as well.

Figure 2:
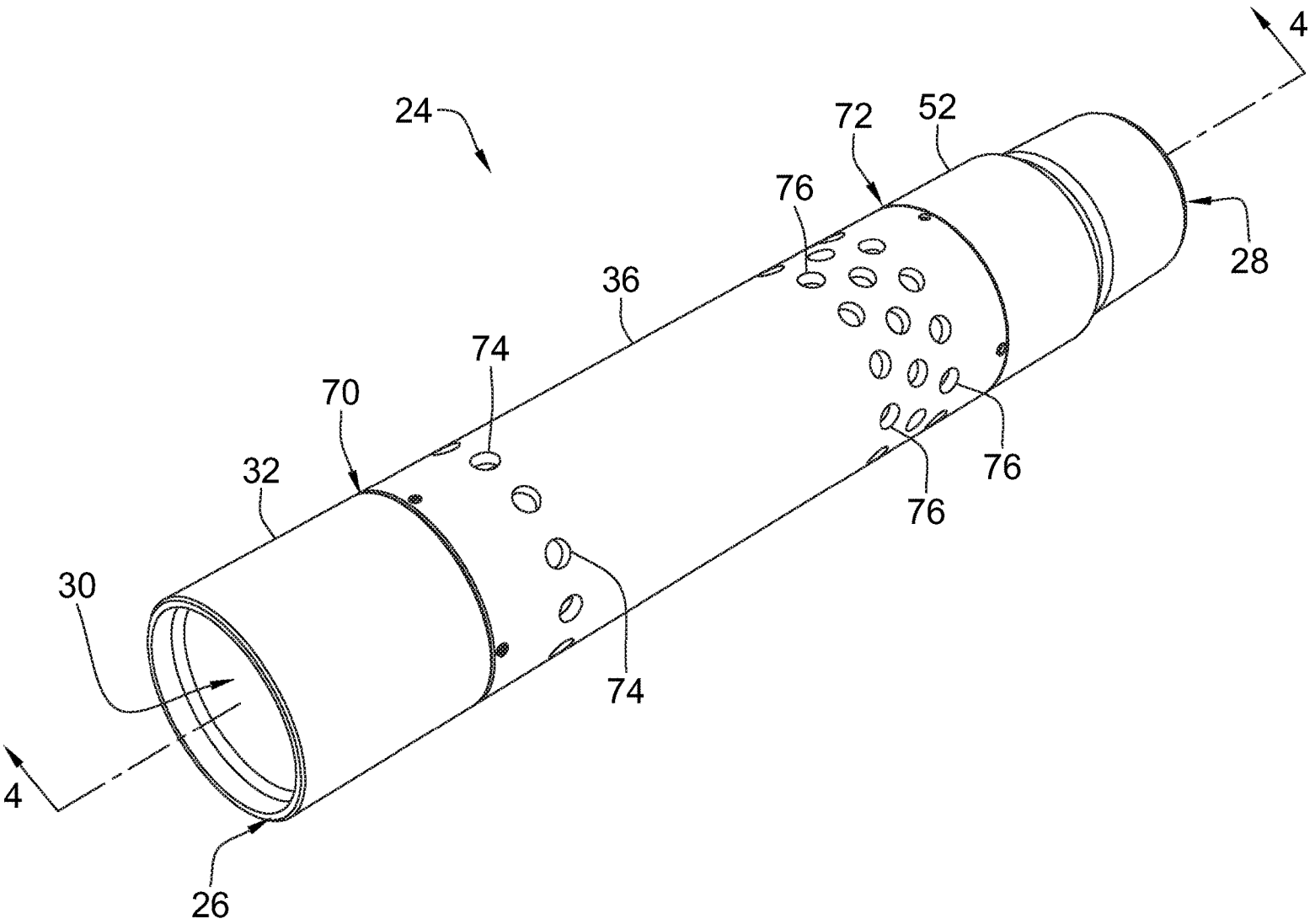
FIG. 2 is a perspective view of one of the control valves of FIG. 1.

Turning now to FIG. 2, a perspective view of one valve body 24 is illustrated. The substantially elongate cylindrical valve body 24 extends between first and second ends 26 and 28, respectively, having a central passage 30 therethrough. The first end 26 of the valve body is connected to adjacent liner or casing section 22 with an internal threading in the first end 26. The second end 28 of the valve body is connected to an adjacent casing section with external threading around the second end 28. Although the threading is described as internal in the first end 26 and external around the second end 28, it will be appreciated that any threading configuration could be used, as well.

Figure 3:
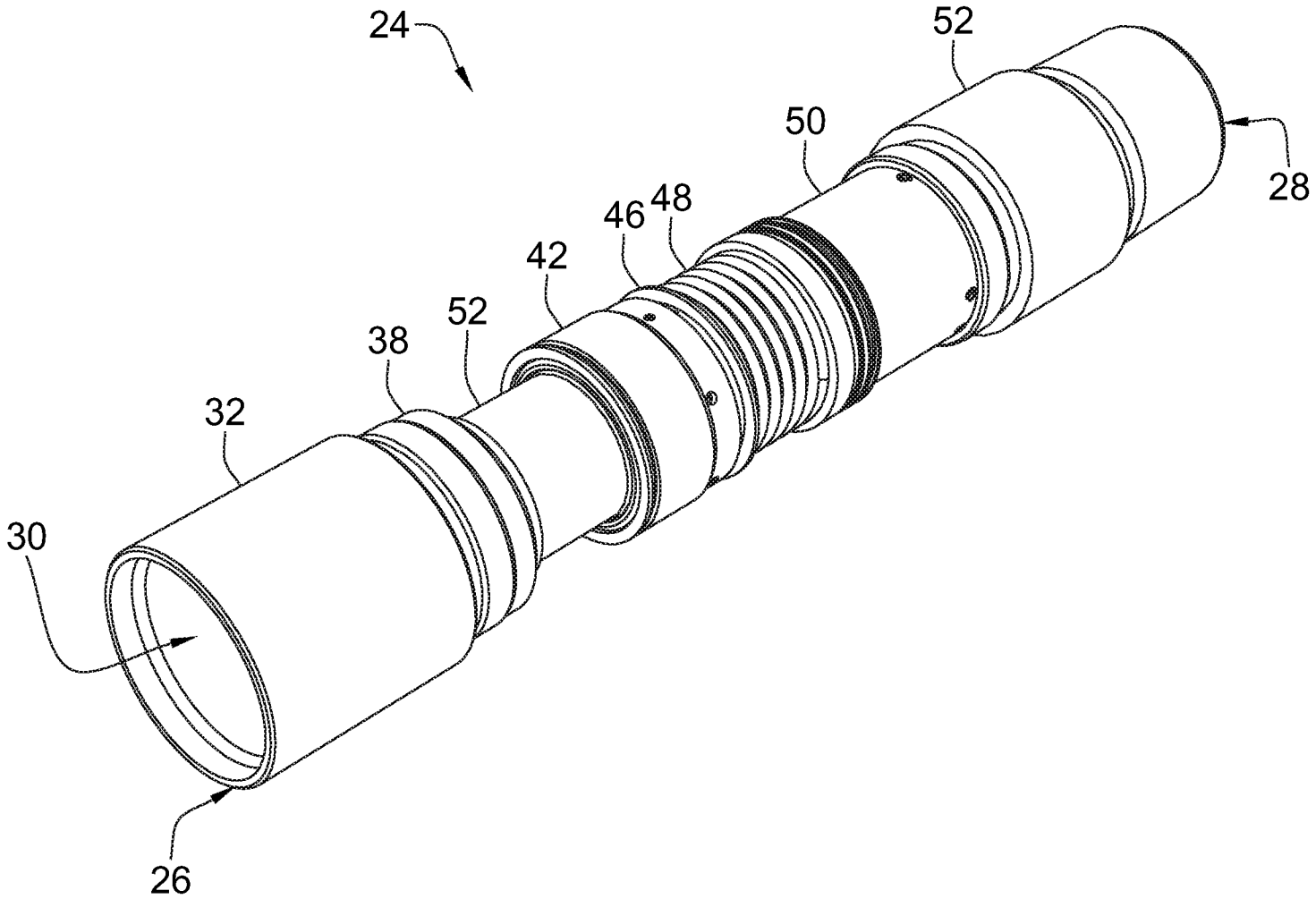
FIG. 3 is a perspective view of the control valve of FIG. 2 with the outer casing removed.
Figure 4:
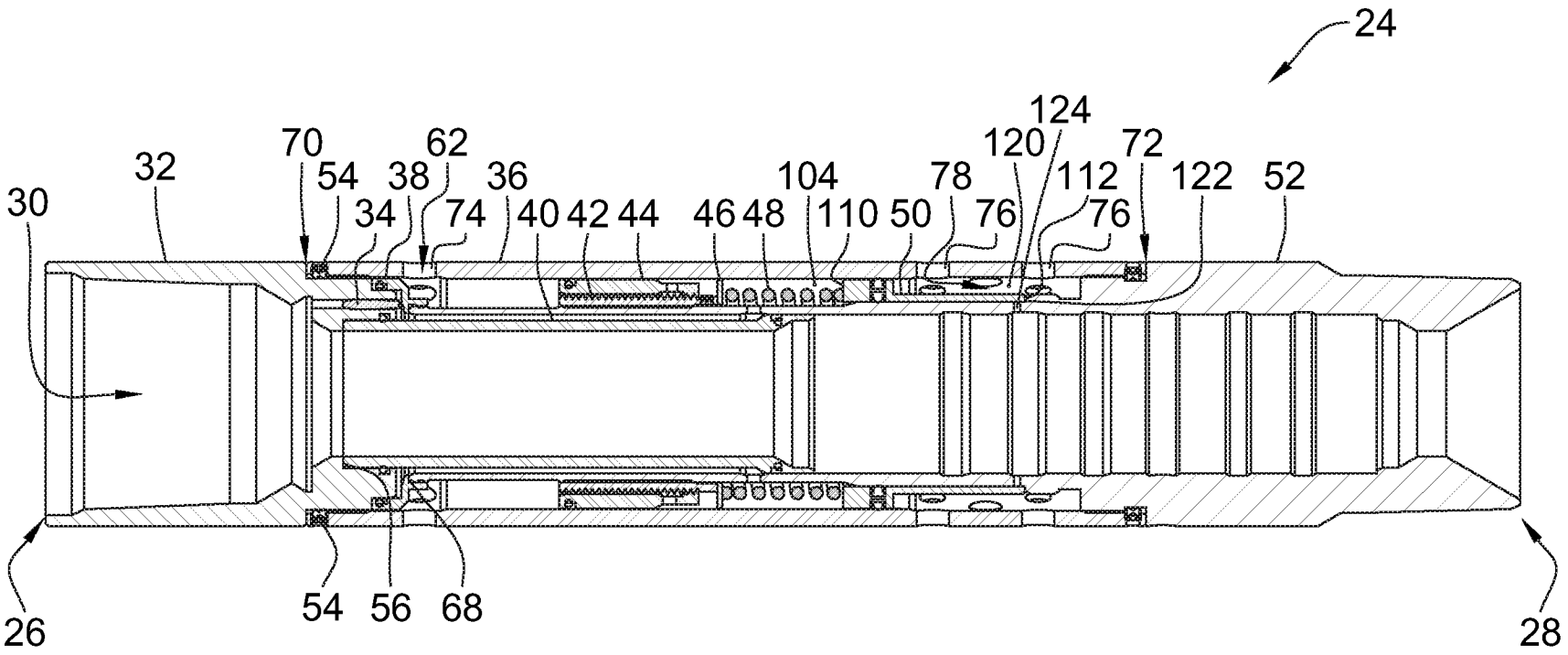
FIG. 4 is a longitudinal cross-sectional view of the control valve of FIG. 2 taken along the line 4-4 in the first extended position with the sleeve closed.

Referring to FIGS. 3 and 4, the valve body 24, extending between first and second ends 26 and 28, respectively, is comprised of a first end connector 32 proximate to the first end 26 with a flow restrictor 34 therein, an outer casing 36 (removed in FIG. 3 for illustration purposes) enclosing a connecting cap 38, a first inner sleeve 40, a threaded sleeve 42, a thread cooperating sleeve 44, a spring seat 46, a compression spring 48, a shifting sleeve 50 and a second inner sleeve with second end connector 52 proximate to the second end 28. As best seen on FIG. 4, a portion of the second inner sleeve with second end connector 52 is substantially enclosed in the outer casing 36.

As best seen on FIG. 2, the elongate cylindrical outer casing 36 extends between first and second ends 70 and 72, respectively. The outer casing 36 includes a plurality of first end ports 74 therethrough proximate to the first end 70, and a plurality of second end ports 76 therethrough proximate to the second end 72. The first and second end ports 74 and 76 extend from the exterior to the interior of the outer casing 36. The first end ports 74 are sized to provide a fluid passage between the production section 16 and the first annular passage 62, as will be described in more detail below. The second end ports 76 are sized to provide a fluid passage between the production section 16 and a second annular passage 78, as will be described in more detail below.

Figure 5:
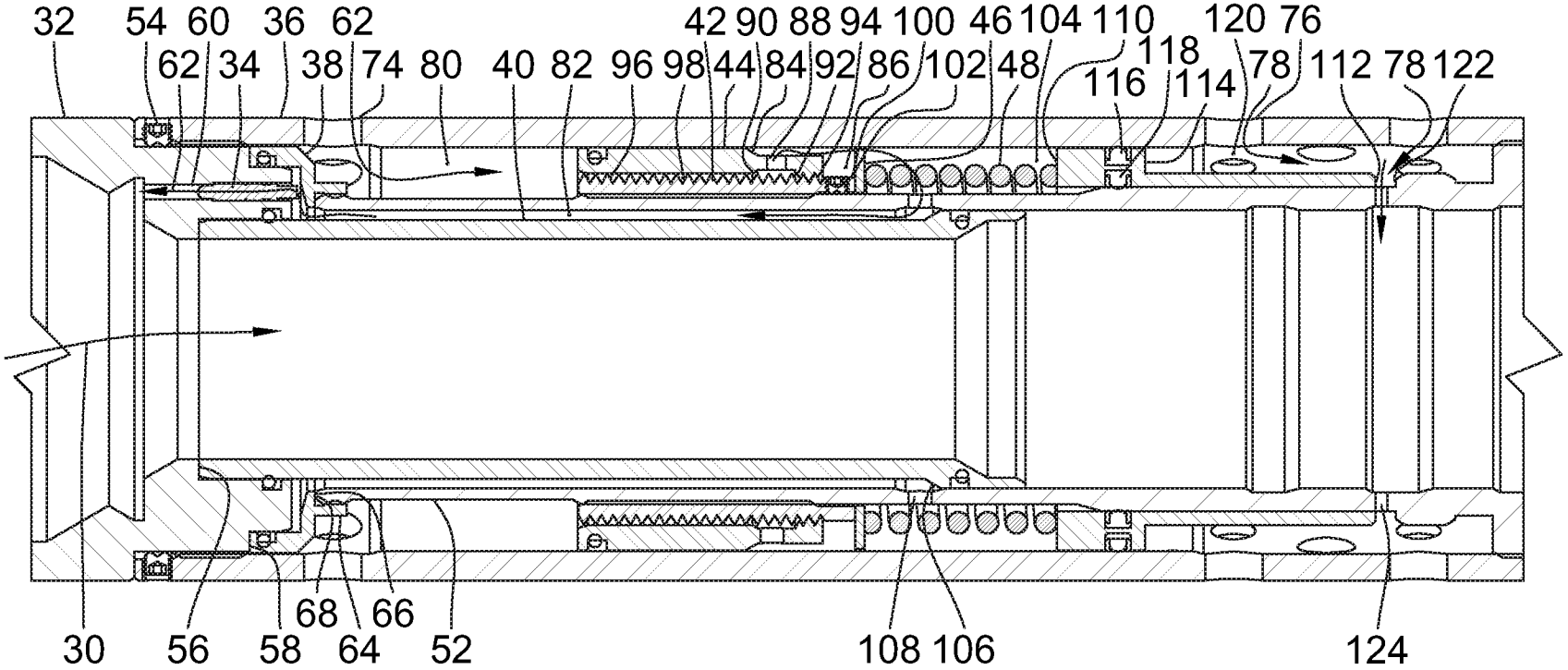
FIG. 5 is a longitudinal cross-sectional view of the middle portion of the control valve of FIG. 2 taken along the line 4-4 in the second retracted position with the sleeve open.

As seen on FIGS. 1 and 4, the first end connector 32 is connected to an adjacent liner or casing section 22 with internal threading in the first end 26. As best seen on FIGS. 4 and 5, the second end of the first end connector 32 is connected to the first end 70 of the outer casing 36 with a threaded connection and a plurality of set screws 54 radially therearound, although it may be appreciated that other connection methods may be useful, as well. The first end of the first inner sleeve 40 abuts an annular shoulder 56 on the interior of the first end connector 32, and is sized to be sealably engaged thereon. The connecting cap 38 engages on the second end of the first end connector 32 and sealably abuts an annular shoulder 58 therearound. As illustrated in FIG. 5, the connecting cap 38 is spaced apart from the first end connector 32 and first inner sleeve 40 so as to form a continuous annular passage therethrough. An aperture 60 extends axially from a void or fourth annular chamber 82, as will be more fully described below, between the first end connector 32 and the connecting cap 38 to permit fluid flow from such void to the interior of the first end connector 32. A flow restrictor 34, as is commonly known, is sized to fit within the aperture 60, providing a fluid passage 62 therethrough, as will be described in more detail below. The flow restrictor may be a standard flow restrictor, as is commonly known, or the flow restrictor may be selected to provide a constant pressure drop therethrough which is dependent only upon the flow rate of the fluid and independent of the viscosity of such fluid. In such a manner, the pressure drop through the flow restrictor will be unaffected by whether there is water or oil flowing therethrough. Examples of such devices may include such as, by way of non-limiting example, a Lee Vico Jet, relief valve or sharp edged orifice.

The first end 70 of the outer casing 36 engages upon the second end of the first end connector 32, as described above. The second inner sleeve with second end connector 52 extends between first and second ends, 68 and 28, respectively. The connecting cap 38 includes a cylindrical extension 64 sized to extend around the first end of the second inner sleeve with second end connector 52. Proximate to the first end 68, the outer diameter of the second inner sleeve with second end connector 52 has an outer diameter smaller than an inner diameter of the outer casing 36 to form a first annular chamber 80 therebetween. As set out above, the connecting cap 38 is spaced around the second inner sleeve with second end connector 52 at the first end 68 to form the fourth annular chamber 82 therebetween.

Within the first annular chamber 80 a threaded sleeve 42 and thread cooperating sleeve 44 are engaged upon each other and sealed to the outer casing 36 and second inner sleeve with second end connector 52 and separate the space therebetween into the first annular chamber 80 and a second annular chamber 86. As illustrated an enlarged portion 84 of the threaded cooperating sleeve 44 engages upon the inner surface of the outer casing with a recessed portion proximate to a second end thereof. External threading 96 extends from an outer surface of the threaded sleeve 42 to engage upon an inner surface of the cooperating threaded sleeve 44 and form a spiral passage 98 therebetween. Proximate to the second end of the thread cooperating sleeve 44, a plurality of ports 88 radially extend therethrough into the spiral passage 98. The inner surface of the thread cooperating sleeve 44 includes a cooperating internal threading to match the external threading 96 thereby limiting the length of the spiral passage 98. The threaded sleeve 42 and the thread cooperating sleeve 44 may be rotated relative to each other to adjust the length of the spiral passage 98. It will also be appreciated that the threaded sleeve 42 and the thread cooperating sleeve 44 may be locked relative to each other by set screws or the like to fix such location.

As illustrated in FIG. 5, a cylindrical extension 100 at the second end of the threaded sleeve 42 extends to and abuts the spring seat 46. It may be appreciated that while the spring seat 46 and threaded sleeve 42 are illustrated as two separate parts in the current embodiment of the invention, they could be co-formed.

The inner diameter of the spring seat 46 is sized to fit the outer diameter of the second inner sleeve with second end connector 52. The outer diameter of the spring seat 46 is sized relative to the inner diameter of the outer casing 36 to allow an annular passage therebetween, connecting the second annular chamber 86 with a third annular chamber 104 formed between the spring seat 46 and a shifting sleeve 50 as will be more fully described below. A compression spring 48 is located within the third annular chamber 104 and extends between the spring seat 46 and the first end of the shifting sleeve 50 the purpose of which will be more fully described below. The outer diameter of the spring 48 is sized to match the outer diameter of the spring seat 46. FIG. 4 illustrates the compression spring 48 in the extended position with the shifting sleeve 50 in the first extended position; FIG. 5 illustrates the compression spring 48 in the retracted position, with the shifting sleeve 50 in the second retracted position.

Referring to FIGS. 4 and 5, the outer surface of the first inner sleeve 40 is sealed to the second inner sleeve with second end connector 52 at a ridge 106 forming an end to the fourth annular chamber 82. A plurality of ports 108 extend between the outer and inner surfaces of the second inner sleeve with second end connector 52, fluidly connecting the third annular chamber 104 with the fourth annular chamber 82.

As illustrated in FIGS. 4 and 5, the valve body 24 includes a shifting sleeve 50 slidably located between the outer casing 36 and the second inner sleeve with second end connector 52 within a fifth annular cavity 120 formed between the second inner sleeve with second end connector 52 and the outer casing 36. The shifting sleeve 50 extends between first and second ends 110 and 112, respectively, and includes an annular wall 114 sealably engaged to each of the outer casing 36 and the second inner sleeve with second end connector 52 through the use of seals 116 and 118 or the like as are commonly known. When in the first extended position with the sleeve closed, as illustrated in FIG. 4, the second end 112 of the shifting sleeve 50 abuts an annular wall 122 on the exterior of the second inner sleeve with second end connector 52, and covers a plurality of ports 124, extending through the second inner sleeve with second end connector 52 and distributed radially therearound. When in the second retracted position with the sleeve open, as illustrated in FIG. 5, the plurality of ports 124 are exposed, forming a fluid passage 78 allowing fluidic communication between the production section 16, the fifth annular cavity 120 and the central passage 30.

Figure 6:
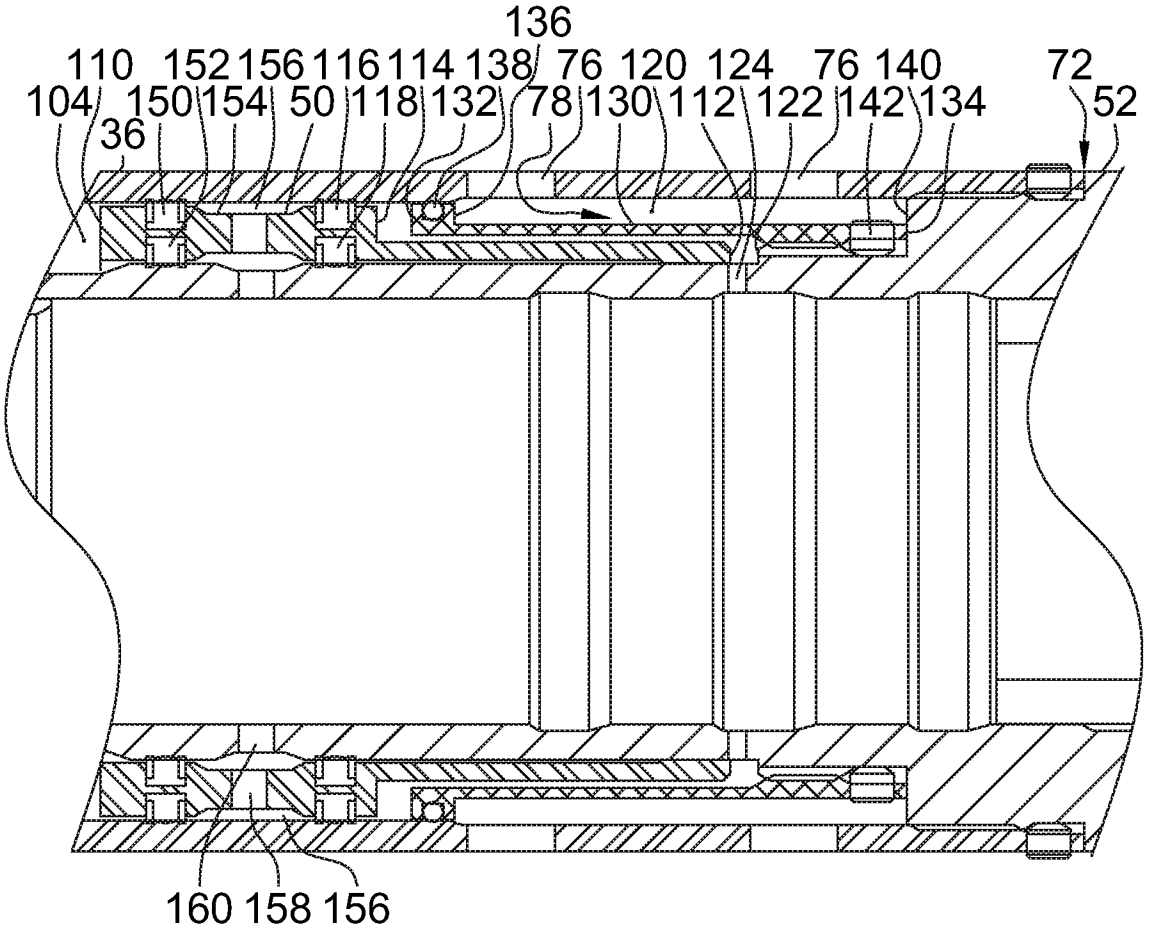
FIG. 6 is a longitudinal cross-sectional view of the middle portion of the control valve of FIG. 2 taken along the line 4-4 in the second retracted position with the sleeve open in a further embodiment of the invention.

An optional annular filter 130, as illustrated in FIG. 6, may be contained within the fifth annular cavity 120, extending between first and second ends, 132 and 134, respectively, and includes an annular wall 136 sealably engaged to the outer casing 36 through the use of a seal 138 or the like as are commonly known. The optional annular filter 130 may axially span the plurality of second end ports 76, with the second end 132 of the annular filter 130 abutting an annular wall 140 on the exterior of the second inner sleeve with second end connector 52. The annular filter 130 is connected to the second inner sleeve with second end connector 52 proximate to the annular wall 140 with threading and a plurality of set screws 142 radially therearound, although it may be appreciated that other connection methods may be useful, as well. When in the second retracted position with the sleeve open, as illustrated in FIG. 6, the plurality of ports 124 are exposed, forming a fluid passage 78 allowing fluidic communication between the production section 16 and the fifth annular cavity 120, through the annular filter 130 and into the central passage 30. The annular filter 130 may be formed using any type of filter medium as is commonly known. The annular filter 130 may limit the influx of sand or other contaminants from the production section 16 to the central passage 30, while permitting fluid flow therethrough.

In a further embodiment of the invention, as illustrated in FIG. 6, the shifting sleeve 50 may include a second set of seals 150 and 152 or the like, as are commonly known, proximate to the first end 110, with the seals 116 and 118 proximate to the annular wall 114. The seals 152 and 116 engage upon the outer casing 36 while the seals 154 and 118 engage upon the second inner sleeve with second end connector 52. The shifting sleeve 50 may include a recessed portion 154 forming an annular cavity 156 between the seals 150, 152 and 116, 118. A plurality of ports 158 extend through the shifting sleeve 50 at the recessed portion 154 and are distributed radially therearound. A plurality of ports 160 extend through the second inner sleeve with second end connector 52 proximate to the recessed portion 154 of the shifting sleeve 50 and are distributed radially therearound. The ports 158 and 160 permit fluid flow between the annular cavity 156 and the central passage 30, the purpose of which will be set out in more detail below.

Turning to FIGS. 4 and 5, when in operation, fluid follows from the production section 16 through the first annular passage 62 to the central passage 30 through a series of ports and cavities. From the production section 16, the fluid passes through the plurality of first end ports 74 into the first annular chamber 80. The fluid continues from the first annular chamber 80, passing through the spiral passage 98, to the plurality of ports 88 through to the second and third annular chambers 86 and 104. Pressure loss through the spiral passage due to viscous effects is proportional to the length over which a fluid travels and the internal diameter of the fluid passage; the spiral passage 98 has an extended length proportional to the circumference of the threaded sleeve 42 and the number of threads throughout the threading 96, and a small diameter defined by the thread profile. As a result, fluids with a higher viscosity such as oil will experience a higher pressure drop through the spiral passage 98 than fluids with a lower viscosity, such that the fluid pressure within the second and third annular chambers 86 and 104 will be lower than it was when it entered the valve body 24 from the production section 16. Fluids with a lower viscosity, such as water or gas, will not experience the same pressure drop, and therefore when water passes through the spiral passage 98 the resulting pressure in the second and third annular chambers 86 and 104 will be higher than it would be for higher viscosity fluids.

From the third annular chamber 104 the fluid passes through the plurality of ports 108 to the fourth annular chamber 82. From the fourth annular chamber 82, the fluid passes through the flow restrictor 34, providing fluid communication between the first annular passage 62 and the central passage 30. As the pressure drop through the flow restrictor can be independent of the viscosity of the fluid, the pressure drop within the second and third annular chambers 86 and 104 is dependent only upon the length of the spiral passage 98 and the fluid viscosity. Therefore, a lower pressure will be formed therein when oil is flowing therethrough and higher therein when water or gas is flowing therethrough.

Referring to FIG. 4, fluid from the production section 16 enters the fifth annular cavity 120 through the plurality of ports 76 at the same pressure as within the production section 16. If the pressure difference between the fifth annular cavity 120 and the third annular cavity 104 is low, such as when water enters the valve body 24, the shifting sleeve will remain in the first extended position with the sleeve closed.

Now turning to FIG. 5, when a higher viscosity fluid, such as petroleum, enters the valve body 24 through the ports 74 and 76, the pressure in the third annular chamber 104 will be lower than the pressure in the fifth annular chamber 120, as previously described. When the pressure differential between the two annular chambers 104 and 120 is sufficient to overcome the spring force in the compression spring 48, the shifting sleeve 50 will be drawn towards the spring seat 46, exposing the ports 124, allowing fluidic communication between the second annular passage 78 and the central passage 30.

As described above, when the production section 16 contains a low viscosity fluid, such as water, a small volume of water may enter the valve body 24 through the first annular passage 62. When the production section 16 contains a higher viscosity fluid, such as petroleum, a large volume of petroleum may enter the valve body 24 through both the first annular passage 62 and through the second annular passage 78. The shifting sleeve 50 is automatically controlled by the viscosity of the fluid in the production section 16, such when there is water entering the valve body 24, the shifting sleeve 50 will close and significantly reduce the volume of water introduced into the production tubing 20. As the valve body 24 is automatic depending on the fluid viscosity, additional testing and shifting tools are not required to determine where water or petroleum is entering the system.

In a further embodiment of the invention, as illustrated in FIG. 6 and outlined above, the annular cavity 156 is in fluidic communication with the central passage 30, with minimal pressure differential therebetween. When a lower viscosity fluid has shifted the shifting sleeve 50 as described above, should either of the seals 150 or 152 fail, permitting fluidic communication between the annular cavity 156 and the third annular chamber 104, the third annular chamber 104 would be pressurized such that the pressure differential between the third annular chamber 104 and the annular cavity 156 is minimal, and therefore insufficient to overcome the spring force in the compression spring 48, automatically returning the shifting sleeve 50 to the closed position, as illustrated in FIG. 4, closing the plurality of ports 124. During failure of either seal 150 or 152, there is fluidic communication between the third annular chamber 104 and the annular cavity 156, and through the plurality of ports 160 into the central passage 30. As the production zone 16 is fluidically connected to the third annular chamber 104 as set out above, the valve fails to an open position such that fluid from the production zone 16 is permitted to enter the valve body 24.

While specific embodiments of the invention have been described and illustrated, such embodiments should be considered illustrative of the invention only and not as limiting the invention as construed in accordance with the accompanying claims.

What is claimed is:

1. An apparatus for controlling the flow of a fluid from a subterranean well zone to a pipe located within a bore in the well zone, the apparatus comprising:

an elongate tubular body having an interior passage and a valve passage extending between an exterior of said tubular body and said interior passage;

a sliding sleeve adapted to selectably cover and uncover said valve passage;

a chamber formed on one end of said sliding sleeve and having an elongate narrow passage formed as a spiral chamber within a wall of said tubular body between said interior passage and said exterior of said tubular body extending thereto from said exterior of said tubular body, wherein a pressure drop of the fluid through said elongate narrow passage is adapted to permit pressure against an opposite side of said sliding sleeve to move said sliding sleeve between a closed and an open position; and a flow restrictor between said chamber and said interior passage of said tubular body wherein said flow restrictor has a pressure drop dependent only upon a flow rate of the fluid therethrough.

2. The apparatus of claim 1 wherein said chamber includes a spring therein biasing said sliding sleeve to said closed position.

3. The apparatus of claim 1 wherein said elongate narrow passage is formed between threading of a first and second tubular bodies.

4. The apparatus of claim 3 wherein said threading is adjustable in length so as to be operable to adjust the pressure drop therethrough.

5. According to a further embodiment of the present invention there is disclosed a method for controlling the flow of a fluid through a valve within a subterranean well zone comprising:

producing a first pressure drop between an exterior of a valve body and a chamber therein through an elongate passage formed as a spiral chamber within a wall of said tubular body between said interior passage and said exterior of said tubular body and creating a second pressure drop between said chamber and an interior of said valve body dependent only upon a flow rate through a flow restrictor;

displacing a sleeve within said valve body when the pressure within said chamber is below a desired pressure; and uncovering an opening between said exterior and said interior of said valve body.

* * * * *